US008246203B2

(12) United States Patent
Hancock et al.

(10) Patent No.: US 8,246,203 B2
(45) Date of Patent: Aug. 21, 2012

(54) LOW PROFILE LED LIGHTING

(75) Inventors: Gavin Hancock, Durham (GB); Elliott Makin, Durham (GB); Anthony Jonathan Sanders, Darlington (GB)

(73) Assignee: Benchmark Electronics Limited, Dunham (GB)

( * ) Notice: Subject to any disclaimer, the term of this patent is extended or adjusted under 35 U.S.C. 154(b) by 267 days.

(21) Appl. No.: 12/677,352

(22) PCT Filed: Sep. 10, 2008

(86) PCT No.: PCT/GB2008/050807

§ 371 (c)(1), (2), (4) Date: Mar. 10, 2010

(87) PCT Pub. No.: WO2009/034382

PCT Pub. Date: Mar. 19, 2009

(65) Prior Publication Data

US 2010/0208474 A1 Aug. 19, 2010

(30) Foreign Application Priority Data

Sep. 10, 2007 (GB) ..... 0717638.1

(51) Int. Cl.
*F21S 4/00* (2006.01)
*F21V 21/00* (2006.01)

(52) U.S. Cl. ..... 362/249.02; 362/311.02; 362/800

(58) Field of Classification Search ..... 362/249.02, 362/311.02, 545, 800
See application file for complete search history.

(56) References Cited

U.S. PATENT DOCUMENTS

| | | | |
|---|---|---|---|
| 4,821,161 | A | 4/1989 | Koontz |
| 6,955,448 | B1 | 10/2005 | Lefferson |
| 7,088,222 | B1 | 8/2006 | Dueker et al. |
| 2005/0047131 | A1 | 3/2005 | Blessing et al. |
| 2006/0077684 | A1 | 4/2006 | Yuen |
| 2006/0274531 | A1 | 12/2006 | Kopf et al. |
| 2007/0165413 | A1 | 7/2007 | Sanner et al. |

FOREIGN PATENT DOCUMENTS

| | | |
|---|---|---|
| AU | 200510975 | 12/2005 |
| DE | 100 26 661 A1 | 12/2001 |
| EP | 1505336 | 2/2005 |
| GB | 2 433 310 | 6/2007 |
| JP | 2003-59330 | 2/2003 |

*Primary Examiner* — Jason Moon Han
(74) *Attorney, Agent, or Firm* — Fay Sharpe LLP

(57) ABSTRACT

A low profile light comprises mating front and back housings (12, 14), between them defining the thickness of the light. An attachment is provided on the back housing, whereby the light is attachable to a base on which the light is to be mounted. A circuit board (16) mounts circuit elements (36) and interconnecting conductive tracks to which LED devices (28) are connected. The board is enclosed and sandwiched between said front and back housings. The front housing is transparent or translucent to transmit light emitted from the LED devices. The circuit elements and LED devices are arranged to be powered by AC mains electricity. The thickness of the light is no greater than 10% more than the sum of the thicknesses of said front and back housings and the maximum 15 dimension of a minimum power-rating two-core mains electricity power cable (18). That is, it is less than 10 mm thick.

35 Claims, 8 Drawing Sheets

LOW PROFILE LED LIGHTING

BACKGROUND

This invention relates to low profile lighting and to LED lighting powered by mains AC electricity. The invention also relates to a combination of such lighting. Indeed, in one embodiment, it relates to a form of LED low profile lighting that in thickness is not much thicker than a typical two-core mains electricity cable that delivers electrical power to the lighting. For example, it may be less than 10 mm thick and in one embodiment is less than 8 mm thick.

Such low profile lighting finds application in many situations where the protrusion of a light from the surface to which it is attached is desirably kept to a minimum. One such situation is in room lighting where the light fitting is desirably flush or negligibly protrusive from a ceiling or wall on which the light is affixed. In this case, cabling to the light typically passes through an aperture of the ceiling or wall and the fitting covers the aperture, masking the cable. Another situation applies in kitchens and workshops where wall-mounted cupboards or units whose lower surface is below normal eye level and is above a work surface or other structure to be illuminated by a light connected to the undersurface of the wall unit. Here, the cable is often pinned to the lower surface so that it enters the side of the light fitting. The difference between these two situations is based on the fact that behind the surface of a wall or ceiling a concealed duct exists or can be provided to lead wiring to the light fitting, whereas in the case of light under a wall cupboard, no such duct generally exists and it would not be desirable to lead the wiring through the interior of the cupboard space.

In this specification, unless the context otherwise dictates, the terms "light", "lighting" and "light fitting" are used interchangeably with reference to the same thing.

Low-profile lighting is known, per se, and indeed employing LED lights. For example, AU-A-2004/00417 discloses lighting comprising a channel-shaped housing for fixture below a wall cabinet, a printed board mounting LED devices and a lens cover. However, there is no description of the power circuit, which presumably comprises a traditional separate low voltage supply such as a mains transformer.

An object of the present invention is to provide such low-profile lighting, but where the need to locate a separate power supply is avoided without loss of the minimal profile.

Thus, in accordance with a first aspect of the present invention there is provided a light comprising:

- mating front and back housings, between them defining a one-dimensional thickness of the light;
- an attachment of the back housing, whereby the light is attachable to a base on which the light is to be mounted;
- a circuit board mounting circuit elements and interconnecting conductive tracks to which LED devices are connected; and
- a minimum power-rating two-core mains electricity cable passing through one of a side aperture and a back aperture of said housings, the conductors of which cable are fixed of said circuit board; wherein
- the circuit board is enclosed and sandwiched between said front and back housings;
- said front housing transmits light emitting from said LED devices;
- said circuit elements and LED devices are arranged to be powered by AC mains electricity; and
- said one-dimensional thickness is no greater than 25% more than the sum of the thicknesses of said front and back housings and the power cable, and not less than the thickness of said cable, wherein
- said housings define a rim region of the light surrounding the circuit elements on the circuit board, and wherein
- labyrinth flanges are formed on one of said front and back housings in said rim region whereby said cable, on passing into the light through one of the apertures, passes along a labyrinthine path around said rim defined by said labyrinth flanges.

By "one-dimensional thickness" is meant simply the thickness of the light in one dimension. Essentially, this means the minimum separation of two parallel solid surfaces between which the light may be disposed. However, this excludes non-essential extensions beyond such dimensions. "Non-essential" means here that the element of the light (if any) that extends beyond the minimum separation is not essential to operation of the light but is simply a design choice without essential functional significance.

By "thickness" of the front or back housing is meant the thinnest dimension of each component that covers the majority of its area and is primarily responsible for excluding the electrical components of the light from contact with users or extraneous components. Such insulation cannot be less than the minimum thickness required to make the product safe. Mandatory safety standards relating to domestic electrical products (such as BSEN 60335 and the like) require products that have no independent safety earth wire to have live parts insulated from accessible surfaces by two independent insulation barriers each at least 1 mm thick or one single reinforced insulation barrier 2 mm thick.

Preferably, the cable has a maximum dimension and a minimum dimension of its cross section and said one-dimensional thickness is no greater than 25% more than the sum of the thicknesses of said front and back housings and the maximum dimension of the power cable, and wherein the cable is arranged between said front and back housings with its maximum dimension extending between said housings.

Alternatively, the cable may be arranged between said front and back housings with its minimum dimension extending between said housings, in which event and said one-dimensional thickness is no greater than 25% more than the sum of the thicknesses of said front and back housings and the minimum dimension of the power cable.

Said one-dimensional thickness is preferably less than 10% more than the sum of the thicknesses of said front and back housings and the maximum dimension of the power cable.

Said one-dimensional thickness is preferably less than 10 mm and preferably less than 8 mm.

Said fixing may be by direct soldering of said conductors to pads on the circuit board. Said side aperture may be separate from said rear aperture, whereby selection of through which aperture the cable passes is made by disassembling the light and passing the other end of the cable, being the end not connected to the circuit board, through the desired aperture and reassembling the light. In this event, unless disassembly of the light opens both the side and back apertures, no plug can permanently be fixed on said other end of the cable and the light must obviously be capable of disassembly. Disassembly can, however, be arranged to open both apertures if each is formed by both the front and rear housings so that separation of them opens each aperture. It is preferred, in any event, that the light is capable of disassembly and to this end the front and rear housings may be interconnected by screws.

Said front housing may have bosses in said rim region and said rear housing may have corresponding screw holes through which screws may pass and engage with said bosses to connect said housings together.

The cable may be arranged in said labyrinthine path with its conductors on a line joining said front and rear housings in the direction of said one-dimensional thickness of the light, and said cable is bent about an axis parallel said line by said flanges sufficiently to create a strain relief for said cable. Preferably, after exiting said labyrinthine path, the outer sheath of the cable ends and said conductors are turned to lie in a plane substantially parallel said front and back housings and pass over an edge of the circuit board to said pads.

Alternatively, said cable may be arranged in said labyrinthine path with its conductors on a line parallel said front and rear housings, and said cable is bent by said flanges about an axis perpendicular said line sufficiently to create a strain relief for said cable.

Preferably, said attachment by which the light may be attached to a base comprises an elongate thin sheet bracket having holes to receive two screws, which holes are on opposite sides of said rim region, said base housing including two screw recesses in said rim region to accommodate the heads of screws connecting said bracket to a base and a shallow recess across its back surface between said screw recesses to accommodate the bracket, whereby the light when connected to the bracket lies flush against a base to which the bracket is connected.

Preferably, said bracket comprises tabs at its ends adjacent to said holes, and said recesses are elongate in a circumferential direction and have windows at one end, whereby, said tabs are receivable in said recesses and, on rotation of the light, said tabs enter said windows to lock the light with respect to the bracket. Said bracket may be sheet metal and resilient.

However, said attachment may comprise apertures in said back housing, and bosses in said front housing coincident with and passing through said back housing, said bosses being adapted to receive screws by which the light may be attached to a surface.

Preferably, said front housing has a central region that is opaque that covers circuit element regions of the circuit board that do not include said LED devices, and a peripheral translucent or transparent region that covers LED device regions of the circuit board. Preferably, said central and peripheral regions of the front housing are surrounded by said rim region. Said peripheral region may comprise an open region of the front housing, the front housing having a cover recess to receive a transparent or translucent cover covering and closing said peripheral region.

However, said front housing may have a central translucent or transparent region that covers LED device regions of the circuit board, the rim region being extended around said central region and covering circuit element regions of the circuit board that do not include said LED devices. In this event, said central region may comprise an open region of the front housing, the front housing having a cover recess to receive a transparent or translucent cover covering and closing said central region.

Preferably, said light is a round disc in outline, where the thickness of the disc comprises said one-dimensional thickness.

In one embodiment of the present invention, the back housing and circuit board are integrated into a combined single element that performs both the functions of back housing and circuit board.

Circuits are known for powering LED devices from mains AC supply. U.S. Pat. No. 5,936,599 and WO-A-2004/038801 disclose banks of paired diodes in anti-parallel configuration driven by an AC power source so that each diode is illuminated when current flows through it during alternate ones of the AC power phases. Thus each LED is illuminated for about half the time and is switched 50 or 60 times per second (depending on the AC source). Flickering is an inevitable consequence of this arrangement. It is an object of the present invention to provide an improved circuit.

Thus, in accordance with a second aspect of the present invention there is provided a light comprising a circuit board mounting circuit elements and interconnecting conductive tracks to which LED devices are connected in a circuit, wherein said circuit comprises:

- a mains voltage AC input;
- two banks of said LED devices arranged in anti-parallel across said AC input;
- a capacitative voltage dropper comprising a capacitor and resistor in series with said banks; and
- an inductor in series with said capacitative dropper to limit surge current on switch on.

Preferably, two inductors are provided, one connected to each terminal of said AC input.

Preferably, a discharge resistor is connected in parallel with said capacitor.

Preferably, a current limiting variable resistor is connected across said AC input in parallel with said banks of LED devices, capacitative voltage dropper and inductor.

Preferably, said first and second aspects of the present invention are combined and said circuit boards of each aspect are one and the same circuit board.

In this event, said circuit elements are preferably surface mount components.

Preferably, said capacitor comprises two capacitors in parallel. Preferably, said anti-parallel banks are arranged in said peripheral region surrounding said central region with one bank around one side and the other bank around the other side of said peripheral region.

BRIEF DESCRIPTION OF THE DRAWINGS

Embodiments of the invention are further described hereinafter, by way of example, with reference to the accompanying drawings, in which.

DETAILED DESCRIPTION

Figure 2B:
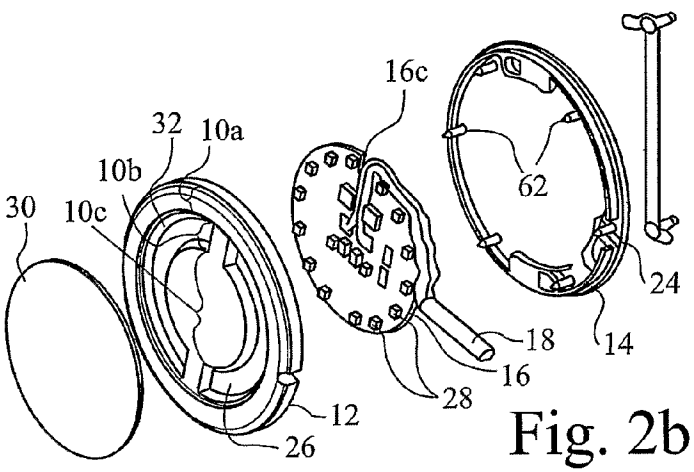
FIGS. 2*a* and *b* are exploded perspective views from (a) the rear and (b) the front of the light in FIG. 1.
Figure 2A:
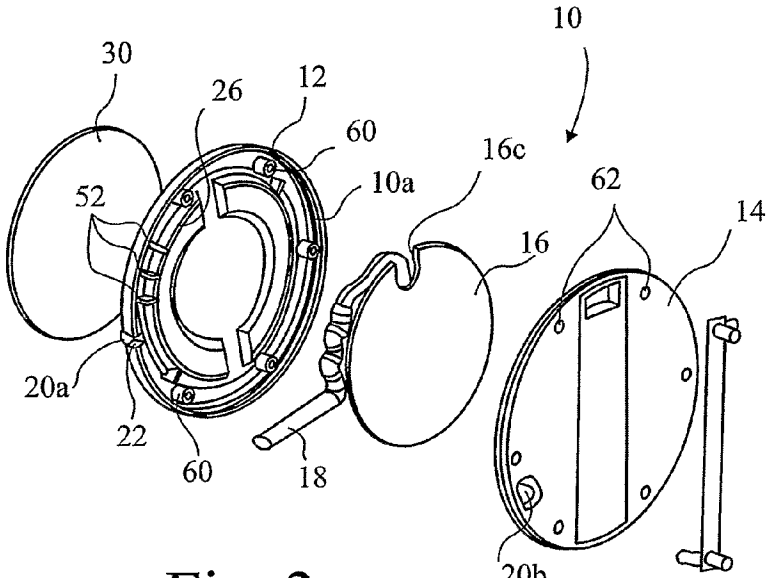

In the drawings, a light 10 is disc-shaped having a thickness of about 8 mm and a diameter of about 80 mm. Referring to FIGS. 2*a* and *b*, the light 10 comprises a front housing 12 and a rear housing 14 which, between them, sandwich a circuit board 16. A cable 18 provides electrical power for the light from a mains plug (not shown).

The housings define three regions of the light: a rim region 10*a*, a light or peripheral region 10*b* and a central region 10*c*.

The cable 18 enters the light 10 through either a side aperture 20*a* or a rear aperture 20*b* formed in the back housing 14. The side aperture 20*a* is formed from a slot 22 in the front housing 12, which slot is closed by a groove 24 of the back housing 14 when the housings are mated together. However the rear aperture could be open on one side so that the cable 18 would not have to be threaded through the hole. Since generally the cable has to pass through a hole drilled in the surface on which the light is fixed when the rear entry aperture is used, it is assumed that the cable would not have a plug on it to effect such threading. On the other hand, specialist, narrow profile plugs could be moulded on to the cable to allow the lights to be simply plugged into a distribution box which could be threaded through holes in the surface on which the light is mounted, and in this case the apertures 20*a,b* are preferably both open and linked so that transfer may be made between them without having to remove the plug.

The front housing 12 has two arcuate openings 26 forming the light region 10*b* and through which light from LED devices 28 on the circuit board 16 is transmitted. A transparent or translucent cover 30 is fitted in a shallow front recess 32 of the front housing 12.

Figure 1:
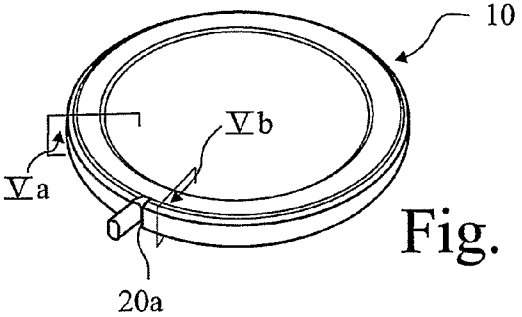
FIG. 1 is a perspective view of a light in accordance with the present invention.
Figure 3:
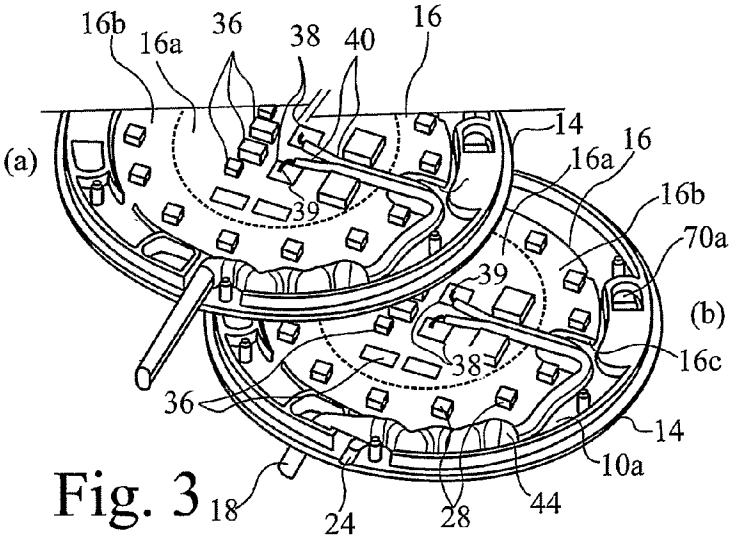
FIG. 3 (*a*) and (*b*) are perspective views showing the cable going through a side and rear aperture of the light of FIG. 1 respectively.

With reference also to FIG. 3, circuit board 16 has a central region 16*a* that corresponds with the central region 10*c* of the light, and a peripheral region 16*b*, which corresponds with the peripheral region 10*b* of the light. Spaced around the peripheral region 16*b* is a plurality of the LED devices 28. In the central region 16*a* are disposed a number of circuit elements 36 (described further below) including two conductor pads 38. To the pads 38 are soldered the conductors 39 of two insulated wires 40 which lie side by side against the top surface of the circuit board 16. The pads may represent the presently lowest profile means of securing the wires 40 to the circuit board. However, other methods exist such as through holes or pin wrapping or even through insulation-displacement clamps. On leaving the area of the circuit board and entering the rim region 10*a* of the light 10, the cables turn on their side and enter the sheathing 44 of the cable 18. A cut-out 16*c* is provided in the edge of the circuit board to give space for the transition of the conductors between an orientation substantially parallel the plane of the front and back housings 12,14 and an orthogonal position in which a line joining, and perpendicular to, each conductor 40 is also orthogonal to such plane.

The cable 18 is a standard two core mains flex for powering mains voltage, low current devices such as lighting. With reference to FIG. 7*b*, such cable 18 comprises two conductors 39 having their own insulation sheaths 48 which are typically coloured blue and brown to distinguish between the phase and neutral statuses of the two conductors.

External sheathing 44 surrounds the two conductors 40 and their individual sheathing 48 keeping the two wires together.

Round twin cable supplied by AEI Cables Limited of Chester-le-Street, Co. Durham, United Kingdom has a minimum (functional) insulation 48 of thickness $t_1$ of 0.7 mm, governed by the cable standard EN60811-1-1, and a MINIMUM AVERAGE supplementary insulation (the outer sheath 44), of thickness $t_2$ of 0.9 mm. The definition of MINIMUM AVERAGE is, for a circular cable, the average of 6 measurements of actual radial wall thickness around the circumference. Essentially this eliminates eccentricity effects. The minimum wall thicknesses (at any point) are: 0.53 mm (functional) and 0.67 mm (supplementary).

The thinnest 3 A flexible cable known to the applicant has 16 strands of 0.2 mm diameter copper in each wire. This gives 16×0.0314 $mm^2$ or 0.502 $mm^2$. The 16 strand bundle is approximately 0.9 mm in diameter. A solid copper wire of 0.5 $mm^2$ area has a diameter of approximately 0.8 mm. The stranded wire takes up more space for the same area, but stranded wire is necessary to make the cable flexible.

Other cables rated at 3 A have been found to contain 21 strands of 0.2 mm copper, giving them a cross sectional area of 0.66 $mm^2$ and a copper bundle diameter of approximately 1.1 mm.

Thus the longest dimension $T_W$ of the cross-section shown in FIG. 7*b* is given by;

$$T_W=2d+4t_1+2t_2$$

and the shortest by:

$$T_S=d+2t_1+2t_2$$

Given the minimum insulation thicknesses provided by applicable standards and 0.5 $mm^2$ of stranded copper, the minimum possible cable outside dimensions are:

Short axis, $T_S=0.9+(2\times0.53)+(2\times0.67)=3.30$ mm.

Long axis, $T_W=(2\times0.9)+(4\times0.53)+(2\times0.67)=5.26$ mm.

The outside dimensions of typical oval cable to BS6500 or CENELEC HD21.5 or Harmonised code HO3VVF are found to be in the range 3.3-3.6 mm×5.25-5.6 mm. Round two core cable to the same standard is typically 5.4-5.6 mm in diameter.

Figure 8:
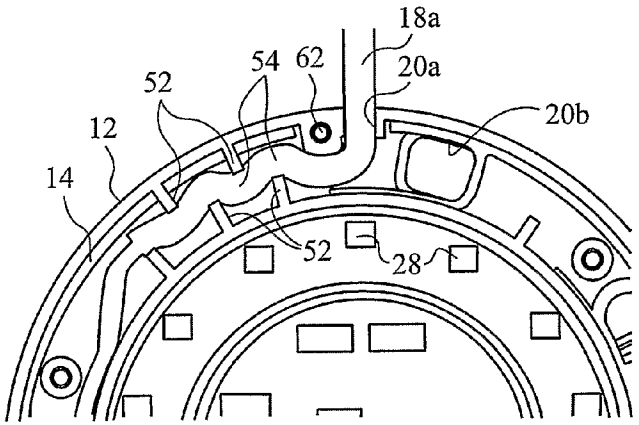
FIG. 8 shows the strain relief arrangement for the cable.

Turning the cable on to its edge in the rim region 10*a* enables the extra space between the housings, in the absence of the board 16, to be exploited. With the cable on its edge, it can flex around labyrinth flanges 52 that depend from the inside of front cover 12 (see FIGS. 2*a*, 5*b* and 8). The flanges 52 force the cable 18 to follow a labyrinthine path to the aperture 20*a,b* and thereby provide strain relief for the connection of the cable to the pads 38. FIG. 8 shows the number of bends 54 in the cable 18, which is therefore securely retained.

Rim region 10*a* also includes a number of bosses 60 (see FIG. 55) adapted to receive screws 62 passing through apertures 64 in the back housing 14.

Figure 4A:
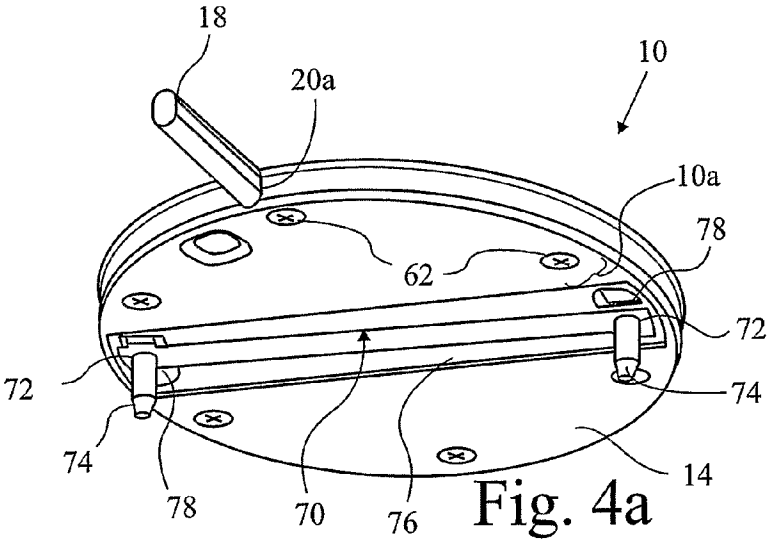
FIGS. 4*a* and *b* are rear perspective views showing the attachment for the light of FIG. 1, as well as the cable exiting (a) through a side aperture and (b) through a rear aperture of the light.
Figure 4B:
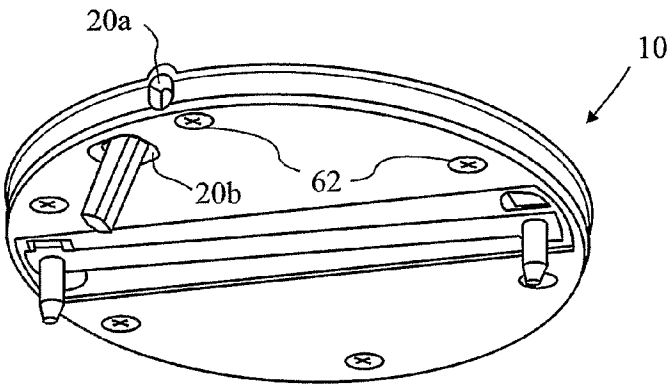
Figure 6:
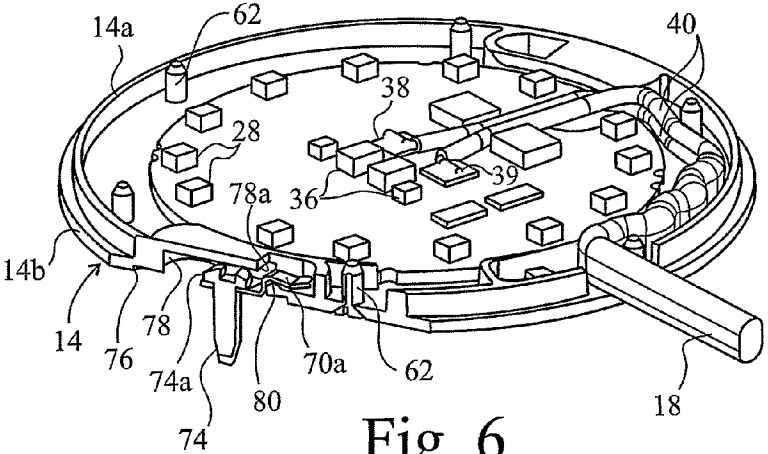
FIG. 6 is a detail showing the attachment and the circuit board.

With reference to FIGS. 4*a* and 4*b*, a rear view of the light 10 is shown in each drawing, the only difference between them being that in FIG. 4*a*, the cable 18 extends through the side aperture 20*a* whereas in FIG. 4*b* it extends through the back housing aperture 20*b*. However, also visible in these drawings is an attachment 70 that comprises a strip of spring steel having two apertures 72 at each end to receive mounting screws 74. The screws 74 (see also FIG. 6) are employed to connect the bracket 70 to a flat surface (not shown) to which the light is ultimately to be fixed. Whether the cable 18 passes through the side or rear apertures 20*a, b* depends on whether the cable is to be hidden (by passing through the base to which the light 10 is fixed), or is to be tacked to the surface. The latter may be the case in applications of the light 10 being sited under wall cabinets and the like.

The bracket 70 is adapted to be received in a shallow recess 76 formed in the back housing 14, and it corresponds in length to the length of the bracket 70. Also, corresponding with the separation of the holes 72, the rim region 10*a* of the back housing 14 is provided with two elongate, circumferentially arranged, screw recesses 78. These are adapted to accommodate the head 74*a* of the screws 74. However, they also include a window 78*a* into which a tab 70*a* of the bracket 70 is adapted to locate in order to fix the light 10 to the bracket 70 as a simple bayonet fixture. Indeed, the tab 70*a* is shaped to snap over a ridge 80 formed on the floor of back housing 14 so that a positive retention is achieved.

A plastics bracket could be employed instead of the spring steel bracket 70, but it would have to be thicker for equivalent strength. However, plastics material does not exhibit the electrical insulation problems that have to be solved with a metal one. It would also be possible to make a plastics holder that surrounded the outer housing and which hooked over the chamfer on the top front edge.

The arrangement described above allows for a hidden fixing, secure retention and easy removal. However, there are of course other ways, particularly if one or more of these requirements are excluded. For instance if a hidden and secure attachment is desired, but not one that is easy to remove, an adhesive (eg double-sided tape) could be employed. If a hidden attachment was unnecessary, one could employ clips around the sides and over the front edge of the housing, such as the plastics bracket described above.

Figure 5A:
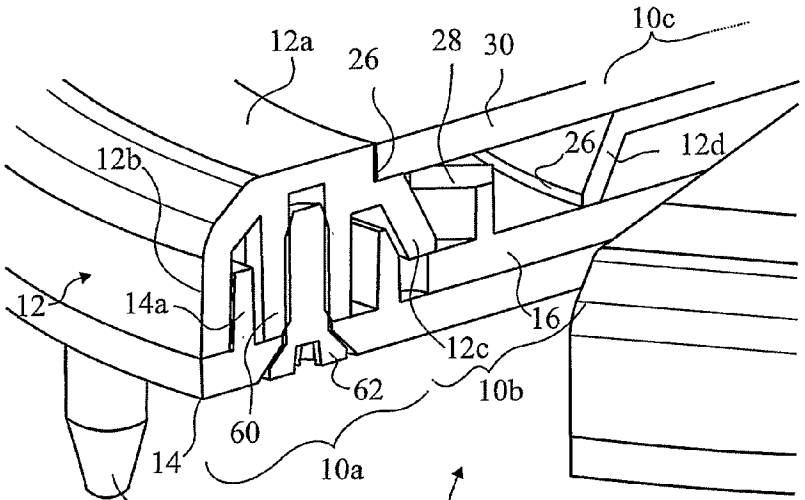
FIGS. 5*a* and *b* are sections in the planes Va and Vb in FIG. 1.
Figure 5B:
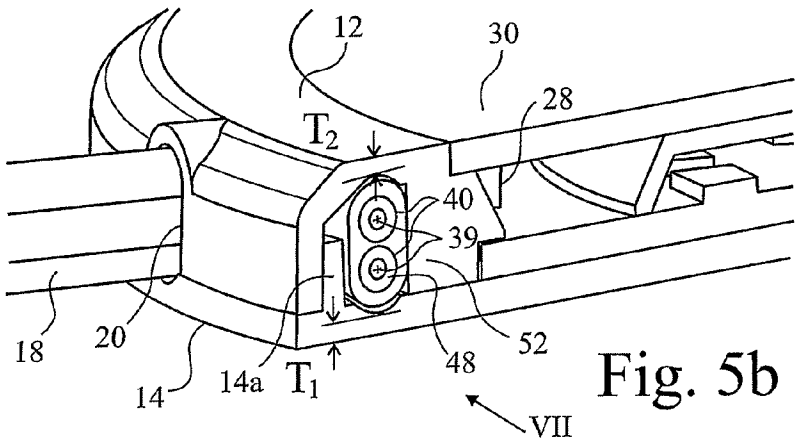

Referring to FIGS. 5*a* and 5*b*, it can be seen that back housing 14 is essentially flat, but has a surrounding edge flange 14*a* close to, but spaced from, the edge 14*b* of the back housing 14. Front housing 12, on the other hand, has a flat face part 12*a*, corresponding with the rim region 10*a* of the light 10, and a depending side edge 12*b* adapted to lie flush against the edge flange 14*a*. Internally of the rim region 10*a*, the front housing 12*a* has a sloping wall 12*c* which, together with a central wall 12*d*, forms the arcuate opening 26 through which light from the LED devices 28 escapes. The walls 12*c*, 12*d* capture and locate the circuit board 16.

Figure 7A:
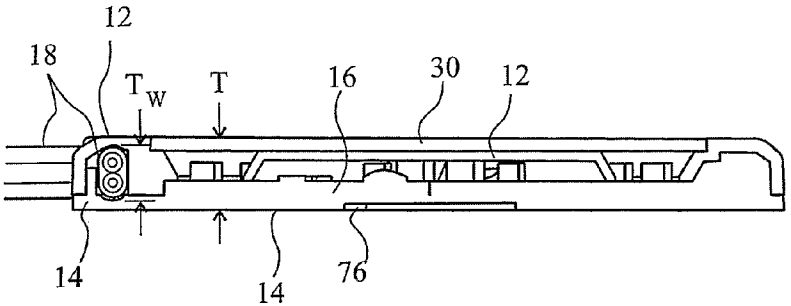
FIGS. 7*a* and *b* are respectively a section in the direction of the Arrow VII in FIG. 5*b* and a cross section of a typical low current mains cable.
Figure 7B:
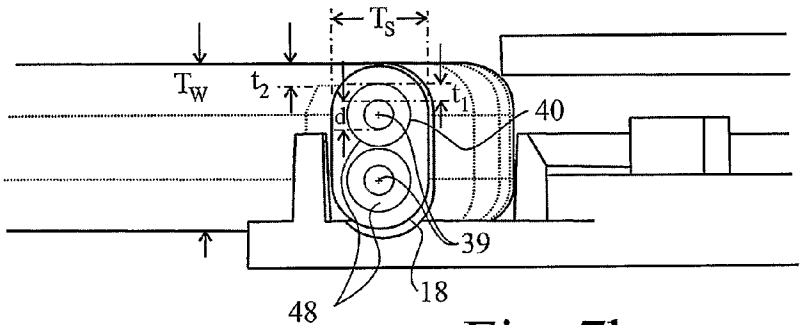

As can be seen in FIGS. 5*b* and 7*a*, the cable 18 is also trapped between the front housing 12 and rear housing 14. It is the dimension of the cable 18 and the thickness of the housings 12,14 that defines the thickness T of the light 10. Indeed, $$T=T_W+T_1+T_2+x$$

where x is a clearance as may be desired and $T_1$ and $T_2$ are the thickness of the housings 12,14 respectively (at least, above and below the cable and contributing to the overall thickness of the light).

As can be seen in FIG. 8, the strain relief of the cable is provided by multiple bends of the cable 18 about axes passing through the long axis of the cross section of the cable. If this method is employed with the cable oriented sideways, far from saving space, the flanges in the front and rear housings (not shown but equivalent to flanges 52) would more than take up the space saved. However, if the cable was flat between the housings then it would be possible to provide strain relief by flanges 52 bending the cable 18 about axes passing through the short axis of the cross section of the cable. This would allow the saving in cable thickness to be exploited, but would cause greater width of the rim region 10*a* of the housings than as shown. In any event, such an arrangement would be beneficial only if the combined thickness of the circuit board 16 and the components mounted on it could be less than or equal to the dimension $T_S$. However, in FIG. 7*a*, the thickness T of the light is determined by the maximum thickness of the cable plus the thickness of the housings, which depends on the material employed and rigidity desired. The housings are made from a plastics material that insulates and enables an earth connection to be avoided. Of course, it must also follow that the thickness of the circuit board 16 and the components 36 mounted on it, should be less than the thickness $T_W$ of the cable 18, but this is quite feasible with current arrangements.

Figure 9:
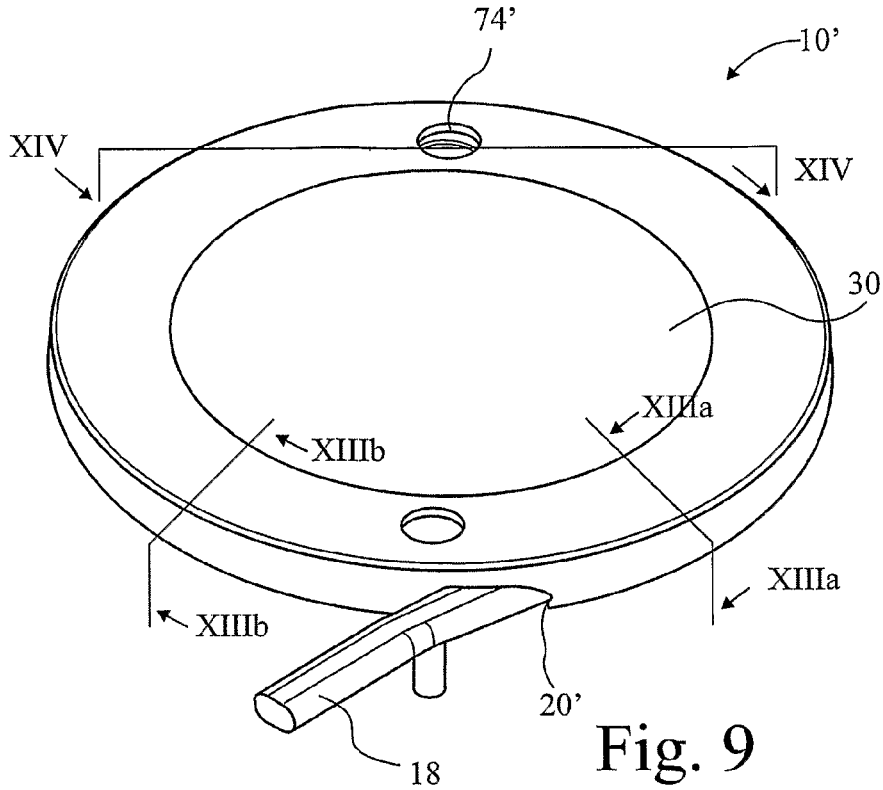
FIG. 9 is a perspective view of a light in accordance with a second embodiment of the present invention.
Figure 10:
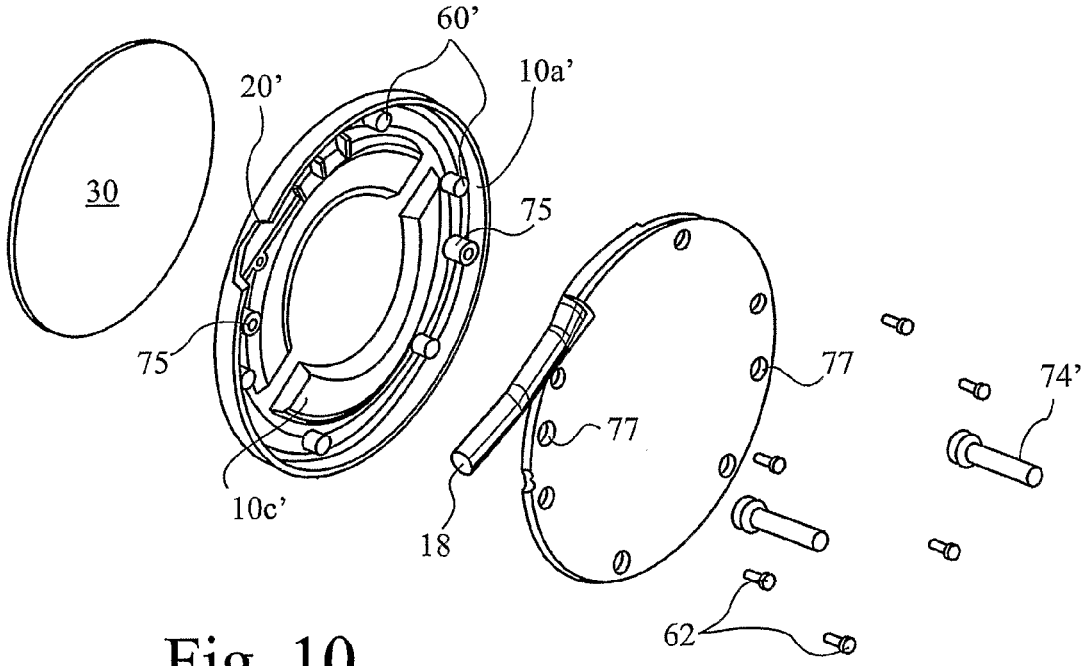
FIG. 10 is an exploded perspective views from the rear of the light in FIG. 9.
Figure 11A:
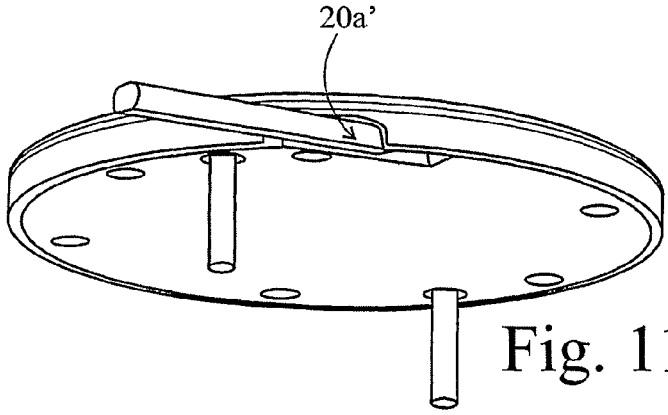
FIGS. 11*a* and *b* are perspective views showing the cable entering from the side and from the rear respectively of the light of FIG. 9.
Figure 11B:
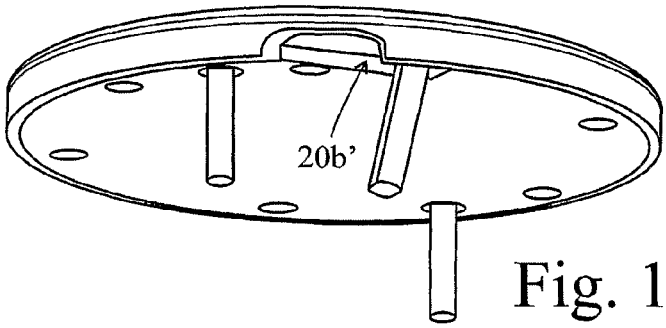

Turning to FIG. 9, a light 10', representing a first alternative embodiment of the present invention, is shown. The light 10' differs from the first embodiment described with reference to FIGS. 1 to 8 in several respects, the first being that the cable is here rotated through 90° so that it is flat inside the light, rather than on edge. This has several impacts. The first is that, since an oval two-core cable cannot easily bend sharply through a tight angle about an axis transverse the line joining its conductors, the cable enters the light somewhat tangentially, requiring an elongated side opening 20'. Secondly, the opening 20' through which the cable enters, is open both to the side and the back, so that the light does not require dismantling in order to change the direction in which it enters the light. The cable can simply be bent, about an axis parallel a line joining its conductors, to direct it to the rear entry (20*b*', see FIG. 11*b*) of the opening 20, or is straightened to go through the side entry (20*a*', see FIG. 11*a*) of the opening.

Figure 12:
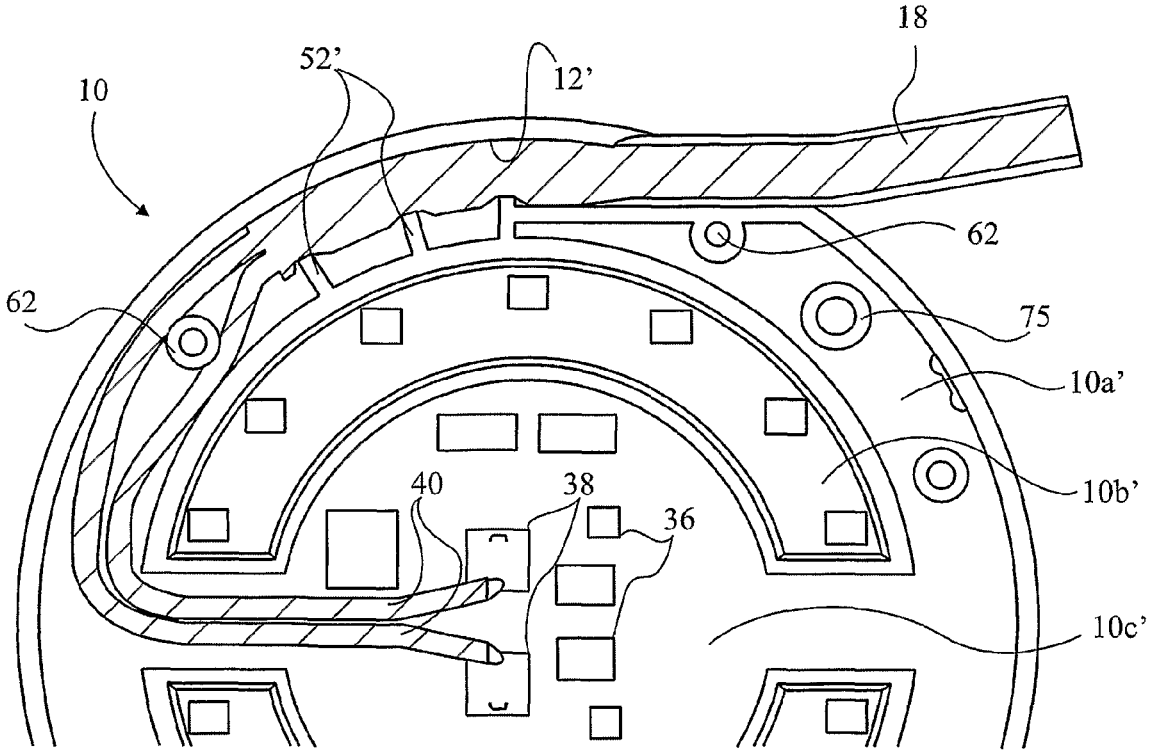
FIG. 12 shows the strain relief arrangement for the cable of the light of FIG. 9.

Thirdly, although as stated above, if the cable grip involves bends about axes parallel the lines joining the conductors, such bends need to be severe and frequent in order to grip the cable sufficiently well enough, as is the case with the first embodiment described above. On the other hand, because of the resistance of the cable 18 to bend about axes transverse to such parallel axes, if the cable grip is in that direction then the degree and number of bending can be less than described above. Provided the cable is confined to prevent its rotation between cable grips, its rim region 10*a*' need not be much wider than the rim 10*a* described above. Indeed, in FIG. 12, the labyrinth flanges 52' are only on one side as the curvature of the outer wall 12' is sufficient resistance with the flanges 52' top create an adequate grip.

Figure 13A:
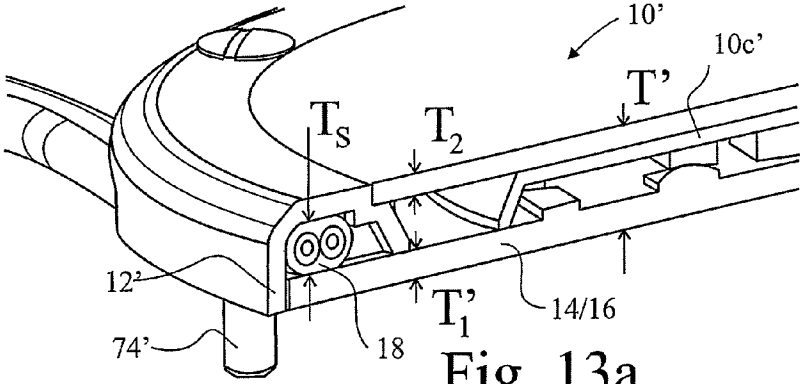
FIGS. 13*a* and *b* are sections in the planes XIIIa and XIIIb in FIG. 9.
Figure 13B:
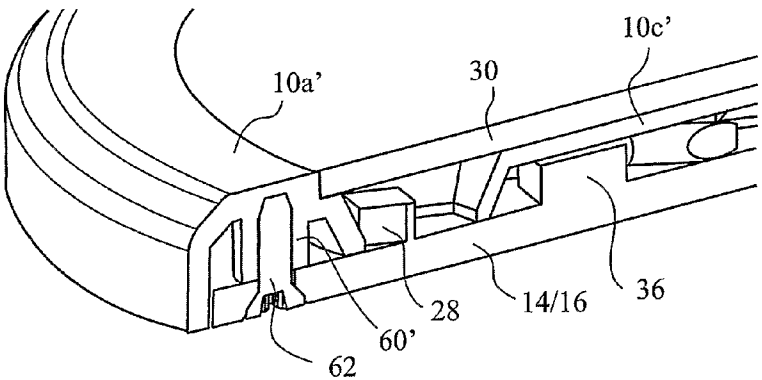

Fourthly, as can be seen in FIGS. 13*a* and *b*, the back housing has been integrated with the circuit board to form a combined board/housing 14/16. The combined board/housing 14/16 is thicker than the individual elements 14,16 of the previous embodiment. However, in combination, it is thinner, leading to an overall thinning of the light 10' although its thickness is still determined by the thickness $T_S$ of the cable 18.

Figure 14:
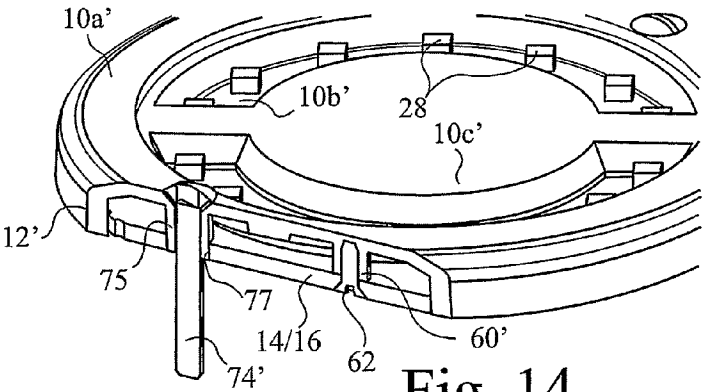
FIG. 14 is a perspective view of the light with a slice on plane XIV in FIG. 9.

Fifthly, in order to ensure a reduce the overall thickness of the light (T' to as little as 6 mm being given by:

$$T'=T_S+T'_1+T_2+x$$

where the symbols have the meanings mentioned above) the wall fixing method has been modified to remove the thickening effect of the metal clip 70 and the groove 76 in the rear housing. Instead, a more traditional approach is employed, as can be seen in FIG. 14, using screws 74' that pass through bosses 75 that extend from the front wall of the front housing 12', in its rim region 10*a*', right through a hole 77 formed in the board/housing 14/16. This increases the distance from the screw surface to any track on the circuit board 14/16 so that the insulation of the live board from the screw is adequate. It also relieves the board/housing from strain caused by tightening of the screws 74'.

There is more flexibility in the positioning of bosses 60' (for screws 62 that connect the front housing 12' to the board/housing 14/16). Consequently, the necessity for the bosses 60' to go through or into the board/housing 14/16 can be avoided by their careful positioning with respect to tracks on the board/housing 14/16.

On the other hand, given that it is not necessary to disassemble the light, (with the opening 20' permitting the cable to be adjusted for side or rear entry without disassembly of the light), and there are not intended to be any user-serviceable components in the light, it may be preferred to weld the housings together. This may be done in a known way, for example by studs on one element being ultrasonically welded to the other element, and replacing the screws 62 entirely.

Otherwise, the light 10' is substantially the same as described above, with the LED's 28 being disposed in a corresponding ring region 10*b*'around the hidden "dark" components 36 of the circuit in the middle, covered by central region 10*c*'. A translucent cover 30 covers the LEDs 28

Figure 15:
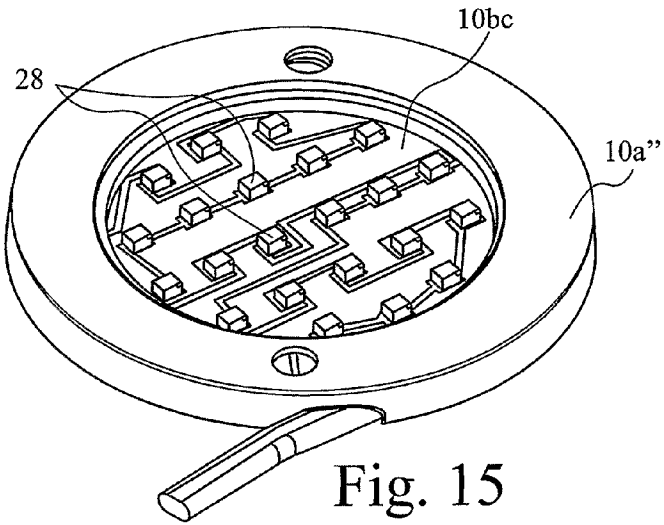
FIG. 15 is a perspective view of a light in accordance with a third embodiment of the present invention (cover removed)
Figure 16A:
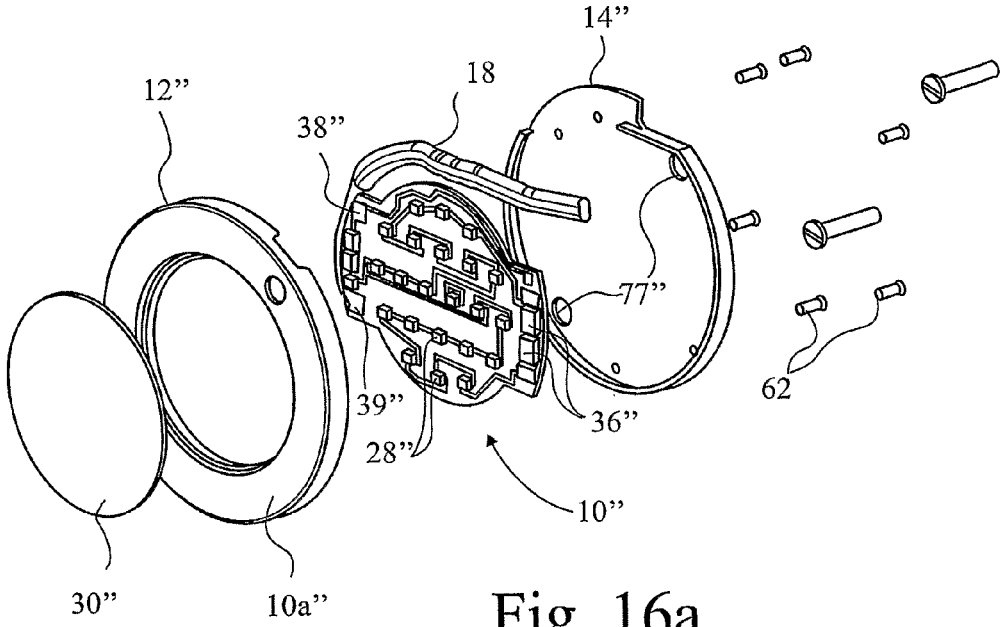
FIGS. 16*a* and *b* are exploded perspective views from (a) the front and (b) the rear of the light in FIG. 15.
Figure 16B:
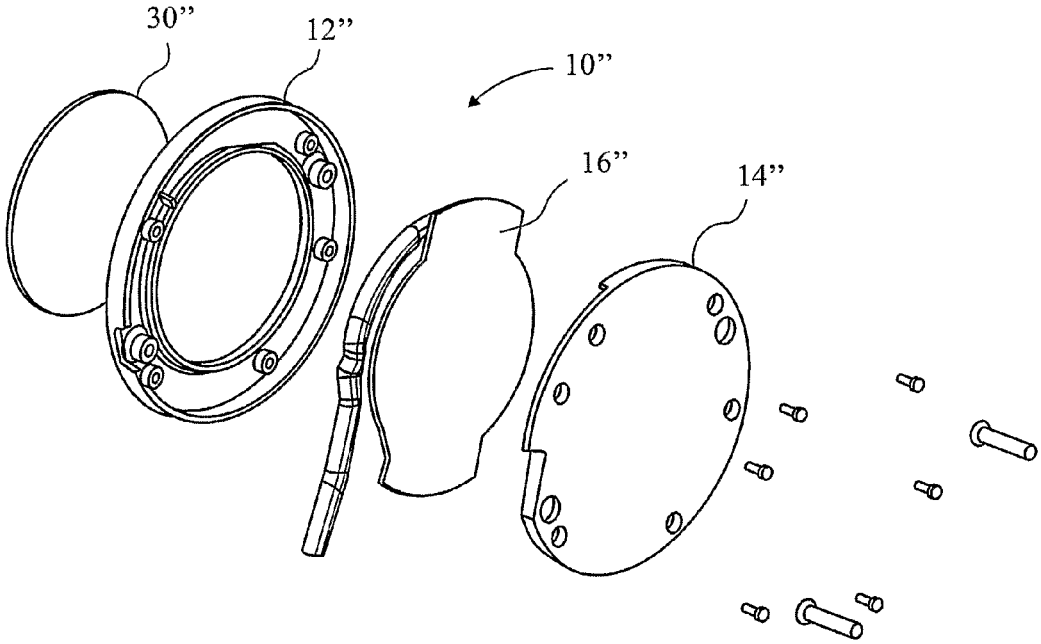
Figure 17:
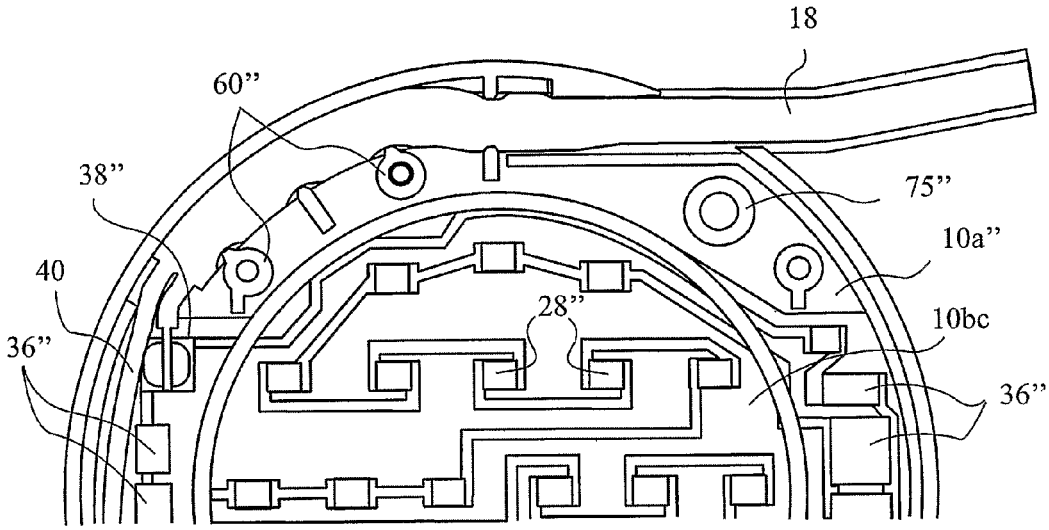
FIG. 17 shows the strain relief arrangement for the cable of the light of FIG. 15.

A third embodiment of a light 10" in accordance with the present invention is illustrated in FIGS. 15 to 17 which embodiment has features common to both the previous embodiments.

Here, front and rear housings 12",14" are provided, with separate intervening circuit board 16", similar to the first embodiment. However, the cable 18 is on its side, the same as in the second embodiment. However, the main difference from both previous embodiments is that the relative positions of the LEDs 28" and the dark circuit components 36" have been swapped, with the dark components 36" around the wider rim region 10*a*" and the LEDs 28" in a combined, single central region 10*bc*. It also means the pads 38",39", to which the conductors 40 of the cable 18 are connected, are around the outside region 10*a*" as well. The increased width of the rim region enables the cable grip to be fitted with ease. Indeed, two labyrinth flanges 52" are also bosses 60".

Figure 18:
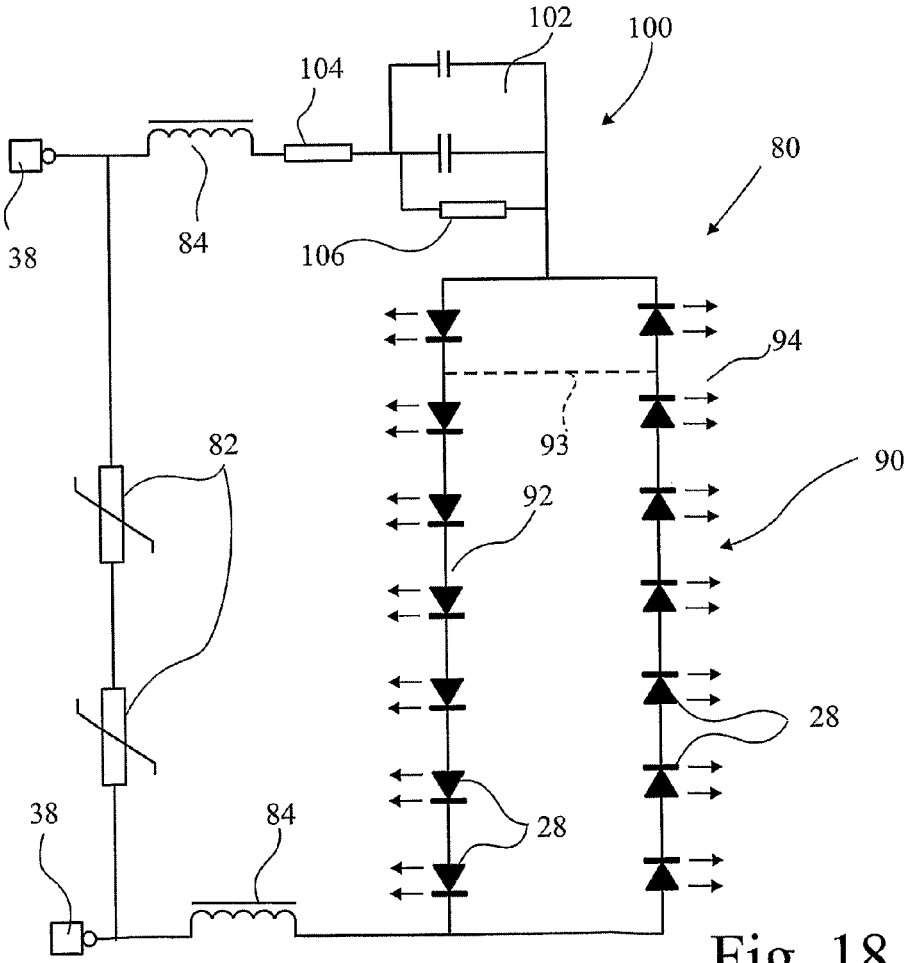
FIG. 18 is a circuit diagram for a light, particularly according to the present invention.

A circuit is needed that can operate with mains voltage and in FIG. 18 a suitable circuit 80 is shown. Pads 38 are connected to the cable 18 (not shown in FIG. 18) and immediately across them are variable current limiting resistors 82. In series with each lead from the pads 38 are inductors 84, one of which is connected to one end of an array 90 of LED devices 28 in two anti-parallel banks 92,94. The LED devices are obviously low voltage DC devices. Indeed, generally each LED is a 3 volt device so that, even with seven of them in series, a 240V mains voltage is too much. Accordingly a capacitative dropper circuit 100 is provided comprising a capacitor 102 in series with a voltage reducing resistor 104 and so that the voltage across each LED 28 is its design voltage. Of course, for each half cycle of the AC mains supply, the LEDs in one bank 90,92 are reverse biased and therefore do not illuminate, whereas the others are forward biased and illuminate. On the other half cycle the LEDs switch on, or off, as the case may be. However, since mains voltage oscillates at 50-60 Hz, the flicker is not particularly evident to the naked eye. In this respect, the capacitor 102 assists in disguising the flicker by smoothing the current through each LED on each forward-biased half cycle so that the LED does not get so bright, but stays illuminated longer.

If desired, the banks 92,94 could be interconnected between each pair of LED devices 28, for instance as shown in dotted lines at 93. However, this is not preferred with the arrangement of the light 10 with its banks 90,92 of LED devices in a circular arrangement around the outside of the remaining circuit elements 36. Of course, this is not necessarily problematic. For example, tracks 93 could go onto the reverse side of the board, or around the outside of the devices 28. Even insulated wires could be provided. Alternatively, an entirely different arrangement, more akin to the layout shown in FIG. 18, could be employed, where the circuit elements 36 are outside the confines of the banks 92,94, so that there is no impediment to tracks 93 (such as for example with the embodiment described with reference to FIGS. 15 to 17.

Resistor 106 is provided in parallel with capacitor 102 to ensure discharge thereof on switch-off. Capacitor 102 may be constituted by two separate devices if one device is too large for the light.

The light 10 is shown and described above as being disc shaped, and evidently round. However, any shape is within the ambit of the present invention. A tear-drop shape is feasible (with the cable labyrinth and all the dark components in the "tail"). The light could be square (with the LED's in the middle or around the edge), or any other shape such as a star or an amorphous shape (a blob). Indeed, the LED's could be randomly scattered about the surface if the objective was not to concentrate the light.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The readers attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A light comprising:

mating front and back housings, between them defining a one-dimensional thickness of the light;

said housing including at least one of a side aperture and back aperture;

a circuit board mounting circuit elements and interconnecting conductive tracks to which LED devices are connected; and a minimum power-rating two-core mains electricity cable passing through at least one of the side aperture and the back aperture, the conductors of which cable are fixed to said circuit board; wherein the circuit board is enclosed and sandwiched between said front and back housings;

said front housing transmits light emitting from said LED devices;

said circuit elements and LED devices are arranged to be powered by AC mains electricity; and said one-dimensional thickness is no greater than 25% more than the sum of the thicknesses of said front and back housings and the power cable, and not less than the thickness of said cable, wherein said housings define a rim region of the light surrounding the circuit elements on the circuit board, wherein labyrinth flanges are formed on one of said front and back housings in said rim region whereby said cable, on passing into the light through one of the apertures, passes along a labyrinthine path around said rim defined by said labyrinth flanges, and wherein said front housing has a central region that is opaque that covers circuit element regions of the circuit board that do not include said LED devices, and a peripheral translucent or transparent region that covers LED device regions of the circuit board.

2. A light as claimed in claim 1, further comprising an attachment of the back housing, whereby the light is attachable to a base on which the light is to be mounted.

3. A light as claimed in claim 2 in which said attachment comprises an elongate thin sheet bracket having holes to receive screws.

4. A light as claimed in claim 3, in which said holes are on opposite sides of said rim region, in which said back housing includes two screw recesses in said rim region to accommodate the heads of screws connecting said bracket to a base, and in which a shallow recess is across a back surface of said back housing between said screw recesses to accommodate the bracket, whereby the light when connected to the bracket lies flush against the base to which the bracket is connected.

5. A light as claimed in claim 4, in which said bracket comprises tabs at its ends adjacent to said holes, and said recesses are elongate in a circumferential direction and have windows at one end, whereby, said tabs are receivable in said recesses and, on rotation of the light, said tabs enter said windows to lock the light with respect to the bracket.

6. A light as claimed in claim 2 in which said attachment comprises apertures in said back housing, and bosses in said front housing coincident with and passing through said back housing, said bosses being adapted to receive screws by which the light may be attached to a surface.

7. A light as claimed in claim 1, in which said cable has a maximum dimension and a minimum dimension of its cross section and said one-dimensional thickness is no greater than 25% more than the sum of the thicknesses of said front and back housings and the maximum dimension of the power cable, and wherein the cable is arranged between said front and back housings with its maximum dimension extending between said housings.

8. A light as claimed in claim 7, in which said one-dimensional thickness is less than 10% more than the sum of the thicknesses of said front and back housings and the maximum or minimum dimension of the power cable.

9. A light as claimed in claim 8, in which said one-dimensional thickness is less than 10 mm.

10. A light as claimed in claim 1, in which said cable has a maximum dimension and a minimum dimension of its cross section and said one-dimensional thickness is no greater than 25% more than the sum of the thicknesses of said front and back housings and the minimum dimension of the power cable, and wherein the cable is arranged between said front and back housings with its minimum dimension extending between said housings.

11. A light as claimed in claim 10, in which said one-dimensional thickness is less than 10% more than the sum of the thickness of said front and back housing and the maximum or minimum dimensions of the power cable and said one-dimensional thickness is less than 8 mm.

12. A light as claimed in claim 1, in which said light is capable of selective disassembly by separation of said front and back housings.

13. A light as claimed in claim 12, in which said side aperture is separate from said rear aperture, whereby selection of through which aperture the cable passes is made by disassembling the light and arranging the cable through the desired aperture and reassembling the light.

14. A light as claimed in claim 13, in which disassembly of the light does not open both the side and back apertures, in which no plug is permanently fixed on said other end of the cable, and in which said arranging comprises threading the end of the cable not connected to the circuit board through the selected aperture.

15. A light as claimed in claim 13, in which disassembly is arranged to open both apertures, each being formed by both the front and rear housings so that separation of them opens each aperture.

16. A light as claimed in claim 13, in which said front housing has bosses in said rim region and said back housing has corresponding screw holes through which screws may be passed to engage with said bosses to connect said housings together.

17. A light as claimed in claim 1, in which said cable is arranged in said path with its conductors on a line joining said front and rear housings in the direction of said one-dimensional thickness of the light, and msaid cable is bent by said flanges about an axis parallel said line sufficiently to create a strain relief for said cable.

18. A light as claimed in claim 17, in which after exiting said labyrinthine path, the outer sheath of the cable ends and said conductors are arranged to lie in a plane substantially parallel said front and back housings and pass over an edge of the circuit board to said pads.

19. A light as claimed in claim 1, in which said cable is arranged in said path with its conductors on a line parallel said front and rear housings, and said cable is bent by said flanges about an axis perpendicular said line sufficiently to create a strain relief for said cable.

20. A light as claimed in claim 1, in which said central and peripheral regions of the front housing are surrounded by said rim region.

21. A light as claimed in claim 1 in which said peripheral region comprises an open region of the front housing, the front housing having a cover recess to receive a transparent or translucent cover covering and closing said peripheral region.

22. A light as claimed in claim 1 which is a round disc in outline, and where the thickness of the disc comprises said one-dimensional thickness.

23. A light as claimed in claim 1 in which the back housing and circuit board are integrated into a combined single element that performs both the functions of back housing and circuit board.

24. A light as claimed in claim 1, including a mains voltage AC input;

two banks of said LED devices arranged in anti-parallel across said AC input;

a capacitative voltage dropper comprising a capacitor and resistor in series with said banks; and an inductor in series with said capacitative dropper to limit surge current on switch on, in which said circuit boards are one and the same circuit board.

25. A light as claimed in claim 24, in which said circuit elements are surface mount components.

26. A light as claimed in claim 24, in which said capacitor comprises two capacitors in parallel.

27. A light as claimed in claim 24:

in which said anti-parallel banks are arranged in said peripheral region surrounding said central region with one bank around one side and the other bank around the other side of said peripheral region.

28. The light as claimed in claim 1 including both a side aperture and a back aperture.

29. A light comprising:

mating front and back housings, between them defining a one-dimensional thickness of the light;

said housings including at least one of a side aperture and a back aperture;

a circuit board mounting circuit elements and interconnecting conductive tracks to which LED devices are connected; and a minimum power-rating two-core mains electricity cable passing through at least one of the side aperture and the back aperture, the conductors of which cable are fixed to said circuit board; wherein the circuit board is enclosed and sandwiched between said front and back housings;

said front housing transmits light emitting from said LED devices;

said circuit elements and LED devices are arranged to be powered by AC mains electricity; and said one-dimensional thickness is no greater than 25% more than the sum of the thicknesses of said front and back housings and the power cable, and not less than the thickness of said cable, wherein said housings define a rim region of the light surrounding the circuit elements on the circuit board, wherein labyrinth flanges are formed on one of said front and back housings in said rim region whereby said cable, on passing into the light through one of the apertures, passes along a labyrinthine path around said rim defined by said labyrinth flanges, and wherein said front housing has a central translucent or transparent region that covers LED device regions of the circuit board and an extended opaque rim region around said central region that covers circuit element regions of the circuit board that do not include said LED devices.

30. A light as claimed in claim 29, in which said cable has a maximum dimension and a minimum dimension of its cross section and said one-dimensional thickness is no greater than 25% more than the sum of the thicknesses of said front and back housings and the maximum dimension of the power cable, and wherein the cable is arranged between said front and back housings with its maximum dimension extending between said housings.

31. A light as claimed in claim 29, in which said cable has a maximum dimension and a minimum dimension of its cross section and said one-dimensional thickness is no greater than 25% more than the sum of the thicknesses of said front and back housings and the minimum dimension of the power cable, and wherein the cable is arranged between said front and back housings with its minimum dimension extending between said housings.

32. A light as claimed in claim 31, in which said one-dimensional thickness is less than 10% more than the sum of the thickness of said front and back housing and the maximum or minimum dimensions of the power cable and said one-dimensional thickness is less than 8 mm.

33. A light as claimed in claim 29, in which said light is capable of selective disassembly by separation of said front and back housings.

34. A light as claimed in claim 29, in which said central region comprises an open region of the front housing, the front housing having a cover recess to receive a transparent or translucent cover covering and closing said central region.

35. The light as claimed in claim 29 including both a side aperture and a back aperture.

* * * * *